US005396781A

United States Patent [19]

Mochizuki et al.

[11] Patent Number: 5,396,781

[45] Date of Patent: Mar. 14, 1995

[54] INTEGRAL TYPE AIR CONDITIONING APPARATUS

[75] Inventors: Koji Mochizuki; Koji Hatano, both of Kusatsu, Japan

[73] Assignee: Matsushita Electric Industrial Co., Ltd., Osaka, Japan

[21] Appl. No.: 137,990

[22] Filed: Oct. 19, 1993

[30] Foreign Application Priority Data

Oct. 19, 1992 [JP] Japan ..... 4-279886

[51] Int. Cl.[6] ..... F25D 23/12

[52] U.S. Cl. ..... 62/262; 62/427

[58] Field of Search ..... 62/262, 404, 410, 413, 62/427; 454/202

[56] References Cited

U.S. PATENT DOCUMENTS

| | | | |
|---|---|---|---|
| 392,917 | 11/1888 | Haurahan | 62/413 |
| 2,711,080 | 6/1955 | Jewell | 62/262 |
| 2,711,088 | 6/1955 | Hess | 62/262 |
| 2,950,667 | 8/1960 | Rose et al. | 62/427 |
| 2,986,016 | 5/1961 | Gillham et al. | 62/427 |
| 2,999,370 | 9/1961 | Eberhart | 62/262 |
| 3,547,025 | 12/1970 | Snedden et al. | 454/202 |
| 3,841,110 | 10/1974 | Schuster et al. | 62/427 |
| 4,111,001 | 9/1978 | Loos | 62/427 |
| 5,056,333 | 10/1991 | Cho | 62/262 |

*Primary Examiner*—Henry A. Bennet
*Assistant Examiner*—William C. Doerrler
*Attorney, Agent, or Firm*—Wenderoth, Lind & Ponack

[57] ABSTRACT

An integral type air conditioning apparatus in which a ventilation operation lever and a ventilation door are integrated with each other.

13 Claims, 7 Drawing Sheets

INTEGRAL TYPE AIR CONDITIONING APPARATUS

BACKGROUND OF THE INVENTION

1. Field of the Invention

The present invention relates to an air conditioning apparatus and more particularly to a ventilation device thereof.

2. Description of the Related Arts

An example of a conventional air conditioning apparatus of this kind is described below with reference to FIGS. 8 through 10.

A partitioning plate 104 which partitions an indoor unit 102 and an outdoor unit 103 from each other is set up on a base frame 101 by means of welding and screws. An indoor fan 106 is driven by a fan motor 105 installed on the partitioning plate 104. Air drawn in from a room through an inlet 110 disposed on a front grill 109 passes through an indoor heat exchanger 107 fixed to the base frame 101 and to the partitioning plate 104 by means of screws and an indoor air guide 108 forming an indoor wind circuit so that endothermic and dehumidifying actions are performed and air is blown out from an outlet 111.

The outdoor unit-103 partitioned from the indoor unit 102 by the partitioning plate 104 is described below. An outdoor fan 114 is driven by a fan motor 105 installed on the partitioning plate 104. Outside air drawn through an inlet 116 disposed on an outer casing 115 passes through an outdoor air guide 112 set up on the base frame 101 by means of welding and screws and is blown through an outdoor heat exchanger 113 fixed to the base frame 101 by means of screws. The outdoor heat exchanger 113 releases the heat of refrigerant having a high temperature and pressure generated by a compressor 117.

A ventilation device is described below. In the indoor unit 102 partitioned from the outdoor unit 103 by the partitioning plate 104, a ventilation opening 118 is formed in a ventilation path of the indoor air guide 108 forming the wind circuit; a fixing portion 121 of a ventilation door 119 closing the ventilation opening 118 is inserted into a groove 120 formed in the indoor air guide 108 so that the fixing portion 121 is fixed to the groove 120; and a ventilation operation lever 122 is inserted into a mounting portion 124 formed on the ventilation door 119 so as to hold a movable portion 123 of the ventilation operation lever 122. The ventilation operation lever 122 comprises a rotatable supporting point 126 interposed between the movable portion 123 thereof and an operation portion 125 thereof. A right-to-left movement of the operation portion 125 allows the ventilation door 119 to be opened and closed, i.e., the ventilation door 119 pivots about the fixing portion 121 of the ventilation door 119, thus allowing ventilation through the ventilation opening 118.

The above-described ventilation device of the integral type air conditioning apparatus is beset, however, by a problem that the ventilation door and the ventilation operation lever are separately formed. In addition, it is necessary to provide the construction for installing the ventilation door on the ventilation opening and on the ventilation operation lever and to perform the installing operation.

Moreover, the ventilation door adjacent to the ventilation opening is opened and closed, i.e., the ventilation door pivots about the fixing portion. Therefore, the ventilation door projects into the ventilation path when the ventilation door is opened, thereby preventing a smooth air flow and thus causing the generation of turbulent air flow and noise.

The construction in which the ventilation operation lever is inserted into the mounting portion formed on the ventilation door requires there to be play between the mounting portion of the ventilation door and the ventilation operation lever. Therefore, the ventilation door and the ventilation operation lever are moved depending on wind speed, thus generating chatter.

The fixing portion of the ventilation door is inserted into the groove formed on the indoor air guide to allow the ventilation door to be opened and closed, i.e., the ventilation door pivots about the fixing portion thereof. Therefore, air leaks from the clearance between the fixing portion and the groove and from the clearance between the ventilation door and the ventilation opening formed in the ventilation path of the indoor air guide when the ventilation door is closed, thus deteriorating the cooling performance of the apparatus.

Further, the ventilation door projects in the ventilation path even when the ventilation door is closed, thereby preventing a smooth air flow and thus causing the generation of turbulent air flow and noises.

SUMMARY OF THE INVENTION

It is a first object of the present invention to provide an integral type air conditioning apparatus which eliminates the provision of a construction for installing a ventilation door on a ventilation opening and installing a ventilation operation lever on the ventilation door, and which eliminates the need for installing the ventilation door on the ventilation opening and installing the ventilation operation lever on the ventilation door.

It is a second object of the present invention to provide an integral type air conditioning apparatus in which the ventilation door does not prevent a smooth air flow in a ventilation path when the ventilation door is open.

It is a third object of the present invention to provide an integral type air conditioning apparatus in which chatter is not generated because there is no play between the ventilation door and the ventilation operation lever.

It is a fourth object of the present invention to provide an integral type air conditioning apparatus in which no clearance is formed between the ventilation door and the ventilation opening.

It is a fifth object of the present invention to provide an integral type air conditioning apparatus in which the ventilation door does not project into the ventilation path.

In accomplishing these and other objects of the present invention, there is provided an integral type air conditioning apparatus in which a ventilation operation lever and a ventilation door are integrated with each other.

The air conditioning apparatus has a construction, opposed to a ventilation opening, for opening and closing the ventilation door.

In the air conditioning apparatus, the ventilation operation lever is secured to the ventilation door by a plurality of connecting portions.

In the air conditioning apparatus, a sealing foam material is formed between the ventilation door and the ventilation opening.

In the air conditioning apparatus, a concave stepped portion is formed on the periphery of the ventilation opening.

According to the above construction, the ventilation door is integrated with the ventilation operation lever, which eliminates the need for the provision of separate parts and moreover, the provision of the construction for installing the ventilation door on the ventilation opening and installing the ventilation operation lever on the ventilation door, and which eliminates the need for installing the ventilation door on the ventilation opening and installing the ventilation operation lever on the ventilation door.

The ventilation door is operated in opposition to the ventilation opening and thus the ventilation door does not prevent a smooth air flow in the ventilation path. Consequently, the generation of turbulent air flow can be reduced in the ventilation path.

The ventilation operation lever is mounted integrally with the ventilation door by a plurality of connecting portions. Therefore, chatter is not generated because there is no play between the ventilation door and the ventilation operation lever.

The sealing foam material is installed between the ventilation door and the ventilation opening. Therefore, the space between the ventilation door and the ventilation opening can be sealed perfectly when the ventilation door is closed. In addition, the foam material prevents noise from being generated when the ventilation door is closed against the ventilation opening surface.

The concave stepped portion is formed on the periphery of the ventilation opening. Therefore, the ventilation door can be accommodated in the concave stepped portion when the ventilation door is closed. Thus, the ventilation door does not prevent smooth air flow in the ventilation path and hence the generation of turbulent air flow can be reduced.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
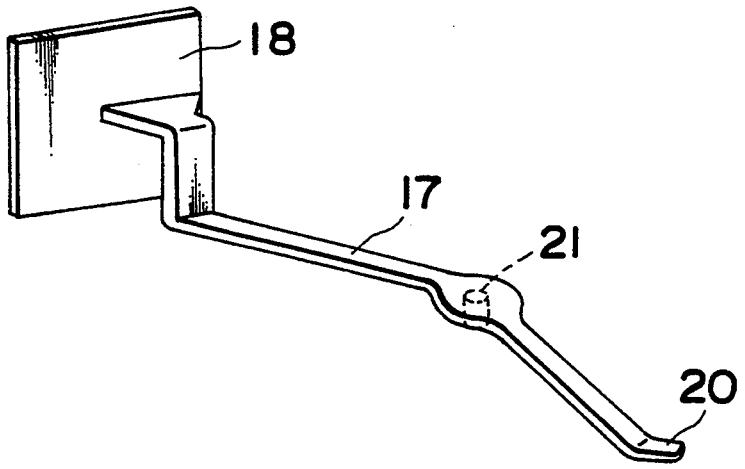
FIG. 1 is a perspective view showing a ventilation door and a ventilation operation lever according to an embodiment of the present invention.

Before the description of the present invention proceeds, it is to be noted that like parts are designated by like reference numerals throughout the accompanying drawings.

Figure 2:
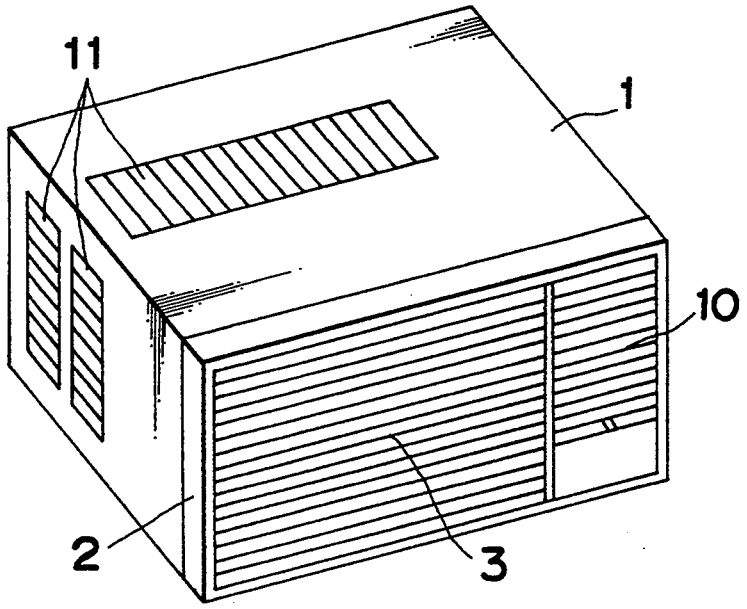
FIG. 2 is a perspective view showing an integral type air conditioning apparatus according to the embodiment of the present invention.
Figure 3:
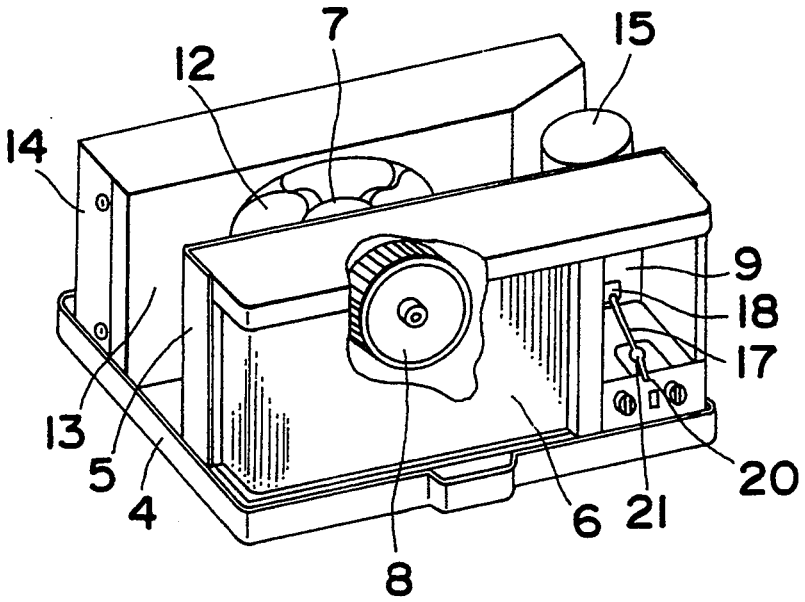
FIG. 3 is a partially cut-away perspective view showing the inside of the integral type air conditioning apparatus of FIG. 2.
Figure 4:
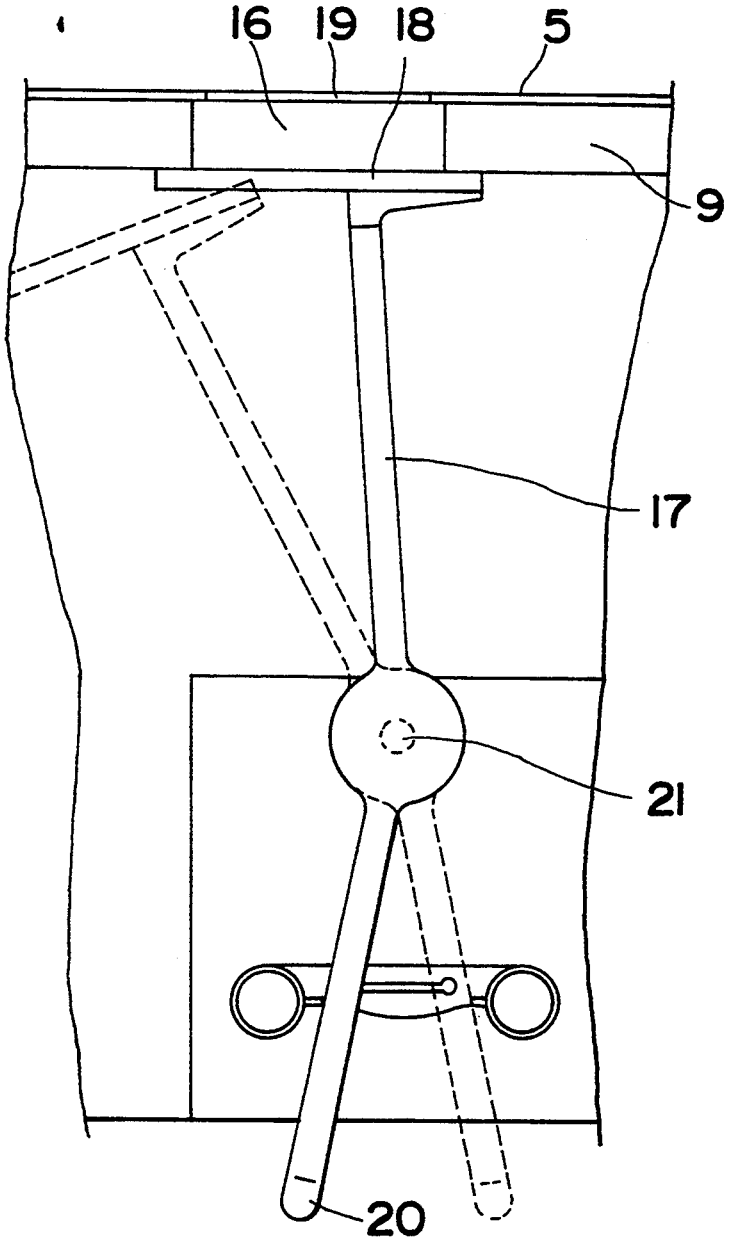
FIG. 4 is a partial plan view showing a ventilation device of the integral type air conditioning apparatus of FIG. 2.
Figure 5:
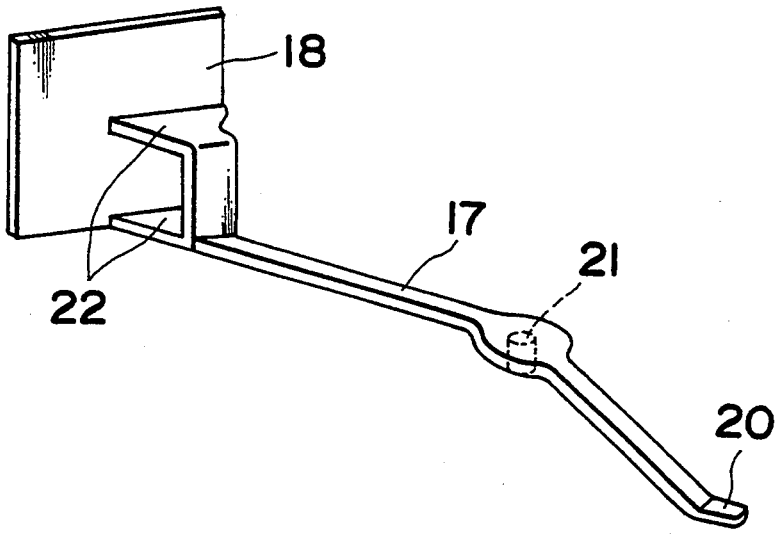
FIG. 5 is a perspective view showing a ventilation door integrated with a ventilation operation lever held by a plurality of connecting portions.
Figure 6:
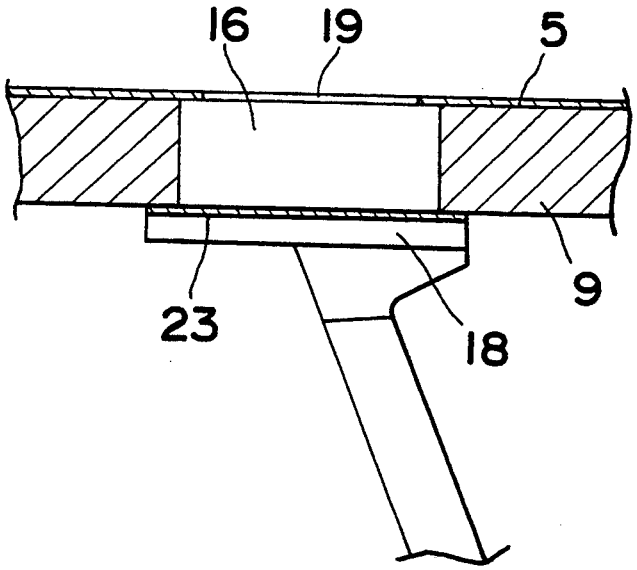
FIG. 6 is a partial sectional view showing a ventilation door and a ventilation opening of the integral type air conditioning apparatus of FIG. 2.
Figure 7:
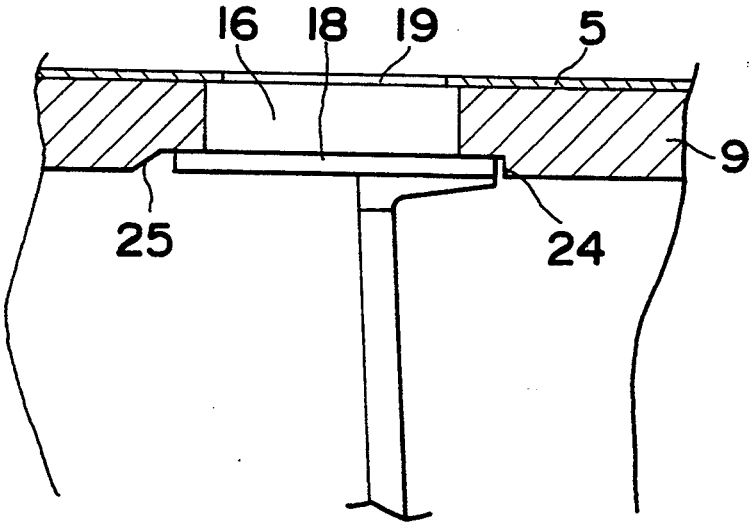
FIG. 7 is a partial sectional view showing the ventilation opening of the integral type air conditioning apparatus of FIG. 2.
Figure 8:
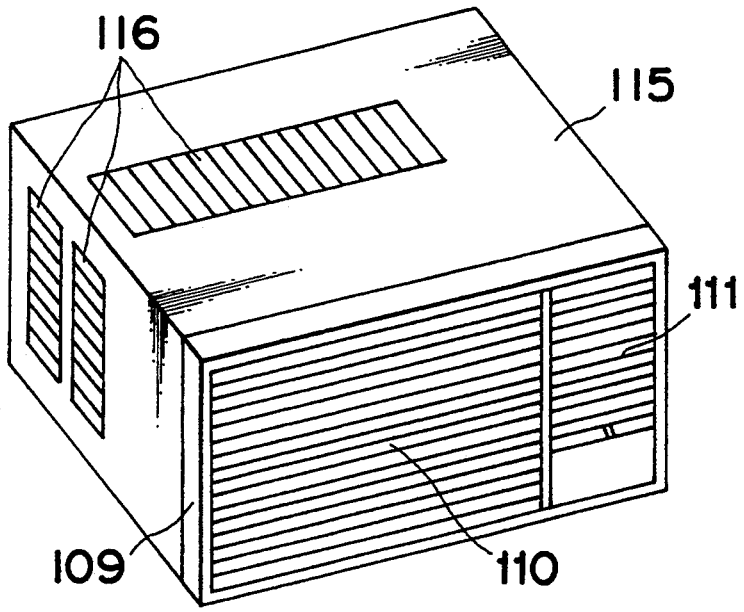
Fig. 8 PRIOR ART
FIG. 8 is a perspective view showing a conventional integral type air conditioning apparatus.
Figure 9:
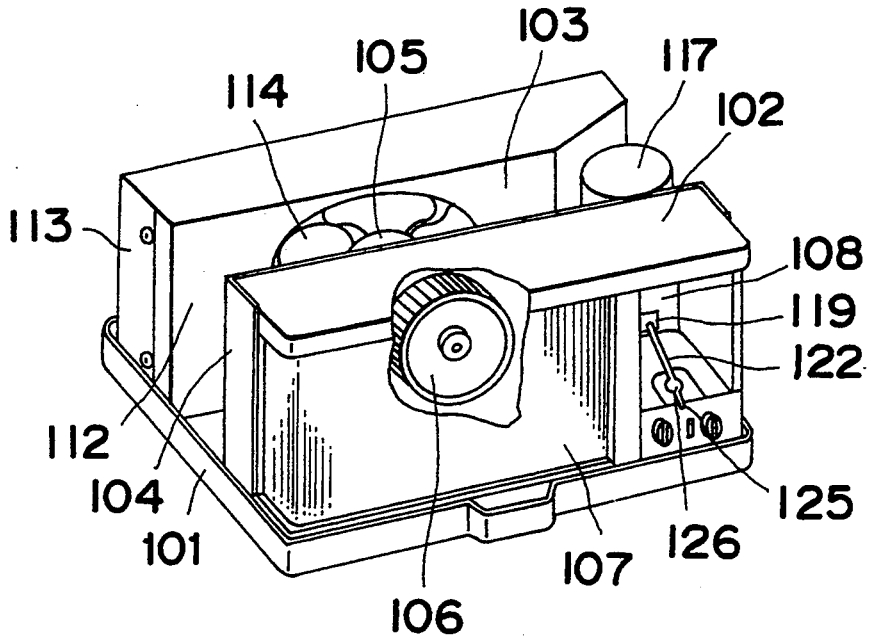
Fig. 9 PRIOR ART
FIG. 9 is a partial cut-away perspective view showing the inside of the integral type air conditioning apparatus of FIG. 8.
Figure 10:
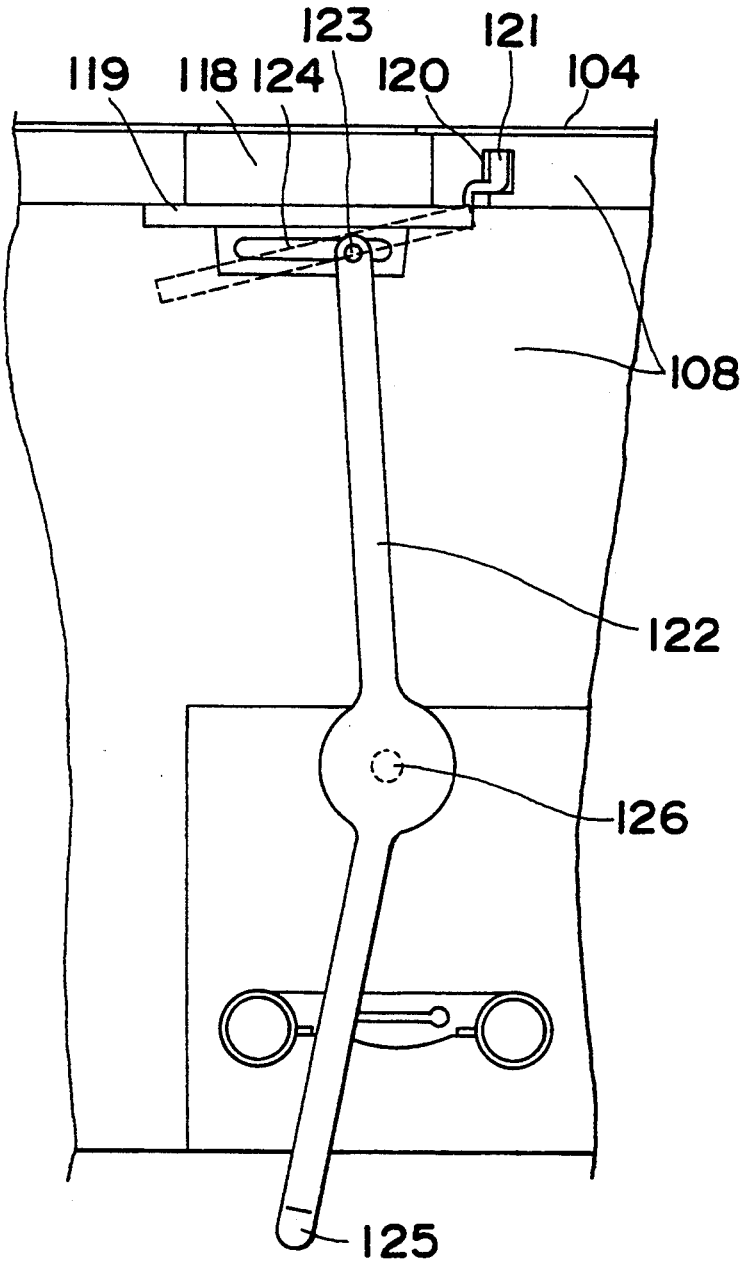
Fig. 10 PRIOR ART
FIG. 10 is a partial plan view showing a ventilation device of the integral type air conditioning apparatus of FIG. 8.

An integral type air conditioning apparatus according to an embodiment of the present invention is described below with reference to FIGS. 1 through 7. Air drawn from a room through an indoor inlet 3 formed in a grill 2 installed on an outer casing 1 is cooled and dehumidified when the air passes through an indoor heat exchanger 6 fixed to a partitioning plate 5 by means of screws. The partitioning plate 5 is set up on a base frame 4. The air is then blown out through an indoor outlet 10 of the grill 2 by an indoor fan 8 driven by a fan motor 7 via an indoor air guide 9. An indoor wind circuit is constituted by the indoor heat exchanger 6, the fan motor 7, the indoor fan 8, the indoor air guide 9, the outdoor inlet 11, and the indoor outlet 10. Outside air drawn through the outdoor inlet 11 disposed on the outer box 1 passes through an outdoor fan 12 driven by the fan motor 7 and an outdoor air guide 13 and is blown through an outdoor heat exchanger 14. An outdoor wind circuit is constituted of the outdoor heat exchanger 14, the outdoor fan 12, and the outdoor air guide 13. The outdoor heat exchanger 14 releases the heat of refrigerant having a high temperature and pressure generated by a compressor 15.

Ventilation to be performed by the ventilation device by the integral type air conditioning apparatus is described below. A ventilation opening 16 formed in a ventilation path of the indoor air guide 9 is opened and closed by a ventilation door 18 formed integrally with a ventilation operation lever 17. Air is exhausted through an opening 19, of the partitioning plate 5, formed at the same position as the ventilation opening 16.

The ventilation -operation lever 17 comprises a supporting point 21 formed between an operation portion 20 projecting from the indoor outlet 10 of the grill 2 and the ventilation door 18. The operation portion 20 is moved right-to-left or vice versa to pivot the ventilation door 18 about the supporting point 21. In this manner, the ventilation opening 16 is opened and closed by the ventilation door 18.

The ventilation door 18 integrated with the ventilation operation lever 17 is held by a plurality of connecting portions 22 so that the ventilation door 18 and the ventilation operation lever 17 are not shaken by air flowing in the ventilation path. The connecting portions 22 have a configuration which does not prevent a smooth air flow in the ventilation path.

A sealing foam material 23 is installed between the ventilation door 18 and the ventilation opening 16 so that the ventilation door 18 has a preferable sealing performance when the ventilation door 18 is closed. In addition, the foam material 23 prevents a noise from being generated when the ventilation door 18 is closed against the ventilation opening 16.

A concave stepped portion 24 is formed about the periphery of the ventilation opening 16 so that the ventilation door 18 is accommodated in the stepped portion 24 when the ventilation door 18 is closed, such that the ventilation door 18 does not prevent smooth air flow in the ventilation path. An inclined surface is formed on the stepped portion 24 so that the ventilation door 18 can be smoothly accommodated in the stepped portion 24.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An integral type air conditioning apparatus comprising:

a base frame;

an outdoor air circulation unit mounted on said base frame and including an outdoor heat exchanger, and an outdoor air circulation circuit operably coupled to said outdoor heat exchanger to allow outdoor air to flow by said outdoor heat exchanger;

an indoor air circulation unit mounted on said base frame and including an indoor heat exchanger, and an indoor air circulation circuit operably coupled to said indoor heat exchanger to allow indoor air to flow by said indoor heat exchanger, said indoor air circulation circuit including an indoor air guide with a ventilation opening formed therein;

a compressor mounted to said base frame;

a refrigerant-circulating pipe operably connected to said compressor and to each of said indoor heat exchanger and said outdoor heat exchanger;

a ventilation device pivotally mounted to said indoor air circulation unit for pivotal movement between a first position in which it covers said ventilation opening formed in said indoor air guide and a second position spaced from said first position; and wherein said ventilation device includes an elongated ventilation operation lever having first and second opposing ends and being pivotally mounted to said indoor air circulation unit at a pivot point located intermediate said first and second ends of said ventilation operation lever, and a ventilation door integrally fixed to said first end of said ventilation operation lever such that said ventilation operation lever and said ventilation door constitute a unitary member in which said ventilation door is non-movably mounted relative to said ventilation operation lever.

2. An integral type air conditioning apparatus as recited in claim 1, wherein said ventilation device further includes a plurality of connecting portions fixedly connecting said ventilation door to said ventilation operation lever.

3. An integral type air conditioning apparatus as recited in claim 1, wherein said ventilation device further includes a foam sealing material mounted to a face of said ventilation door for forming a seal between said ventilation door and said ventilation opening when said ventilation device is in said first position.

4. An integral type air conditioning apparatus as recited in claim 1, wherein said indoor air guide has a recess formed therein about said ventilation opening.

5. An integral type air conditioning apparatus as recited in claim 4, wherein said recess formed in said indoor air guide constitutes a means for receiving said ventilation door therein when said ventilation device is in said first position.

6. An integral type air conditioning apparatus as recited in claim 1, further comprising an outer casing mounted over said indoor and outdoor air circulation units; and a front grill mounted to said base frame adjacent said indoor air circulation unit, said front grill having an indoor air inlet for introducing air into said indoor air circulation circuit, and an indoor air outlet for exhausting air from said indoor air circulation circuit which passes through said ventilation opening formed in said indoor air guide.

7. An integral type air conditioning apparatus as recited in claim 6, further comprising an indoor fan mounted in said indoor air circulation circuit; and an outdoor fan mounted in said outdoor air circulation circuit.

8. An integral type air conditioning apparatus as recited in claim 7, further comprising a partition plate mounted to said base frame and partitioning said indoor air circulation unit from said outdoor air circulation unit; and a fan motor mounted to said partition plate and being operably connected to each of said indoor fan and said outdoor fan.

9. An integral type air conditioning apparatus as recited in claim 8, wherein said outdoor air circulation circuit includes an indoor air guide through which outdoor air is blown by said outdoor fan.

10. An integral type air conditioning apparatus as recited in claim 1, further comprising an indoor fan mounted in said indoor air circulation circuit; and an outdoor fan mounted in said outdoor air circulation circuit.

11. An integral type air conditioning apparatus as recited in claim 10, further comprising a partition plate mounted to said base frame and partitioning said indoor air circulation unit from said outdoor air circulation unit; and a fan motor mounted to said partition plate and being operably connected to each of said indoor fan and said outdoor fan.

12. An integral type air conditioning apparatus as recited in claim 1, wherein said ventilation device is disposed partially in said indoor air circulation circuit; and said ventilation operation lever includes at said second end thereof an operation portion extending outwardly of said indoor air circulation circuit.

13. An integral type air conditioning apparatus as recited in claim 1, wherein said ventilation door of said ventilation device is connected to said indoor air circulation unit only by the pivotal connection of said ventilation operation lever to said indoor air circulation unit.

* * * * *